US006457218B1

(12) United States Patent
Lawrence

(10) Patent No.: US 6,457,218 B1
(45) Date of Patent: Oct. 1, 2002

(54) PLASTIC CLIP

(76) Inventor: Lloyd L. Lawrence, 2050 W. 7th Ave., Denver, CO (US) 80204

( * ) Notice: Subject to any disclaimer, the term of this patent is extended or adjusted under 35 U.S.C. 154(b) by 24 days.

(21) Appl. No.: 09/659,883

(22) Filed: Sep. 12, 2000

(51) Int. Cl.[7] ..... A44B 21/00; B21D 31/00

(52) U.S. Cl. ..... 24/563; 24/3.12; 24/67.9; 24/545

(58) Field of Search ..... 24/569, 545, 67.9, 24/370, 306, 546

(56) References Cited

U.S. PATENT DOCUMENTS

| | | | | | |
|---|---|---|---|---|---|
| 20,364 | A | * | 5/1858 | Pierce | 24/563 |
| 609,486 | A | | 8/1898 | Wilson | |
| 1,621,008 | A | | 3/1927 | Fricker | |
| 1,675,286 | A | | 6/1928 | Van Valkenburg | |
| D244,907 | S | | 7/1977 | Link | |
| 4,747,496 | A | | 5/1988 | Rendine | |
| 4,889,380 | A | * | 12/1989 | Pillifant, Jr. | 296/97.6 |
| 4,903,375 | A | | 2/1990 | DiFranco | |
| D328,187 | S | * | 7/1992 | Saurette | D3/54 |
| D363,453 | S | * | 10/1995 | Herdt | D11/78.1 |
| D382,592 | S | | 8/1997 | Maruchi | |
| 5,697,131 | A | | 12/1997 | Hunt et al. | |
| D394,745 | S | * | 6/1998 | Egelja | D2/999 |
| 5,913,618 | A | * | 6/1999 | Yosha | 24/3.12 |
| 5,970,777 | A | * | 10/1999 | Hunt et al. | 24/563 |

FOREIGN PATENT DOCUMENTS

| | | | | |
|---|---|---|---|---|
| AI | 0253453 | * | 4/1967 | 24/545 |

* cited by examiner

*Primary Examiner*—Victor Sakran
(74) *Attorney, Agent, or Firm*—Ramon L. Pizarro; Edwin H. Crabtree

(57) ABSTRACT

A plastic clip of unitary, one piece construction, and a method for making the same is disclosed. The clip includes a first leg of a first thickness, a second leg of a second thickness, and a bridging section joining the first leg and the second leg, the bridging section being of a dimension that upon cooling or curing of the plastic material, the bridging section biases the first leg against the second leg.

14 Claims, 2 Drawing Sheets

10

PLASTIC CLIP

BACKGROUND OF THE INVENTION (a) Field of the Invention

This invention generally relates to a resilient plastic clip and method for making the clip. More particularly, but not by way of limitation, to a plastic clip having legs or arms that are preloaded or biased directly against one another when the clip is not in use.

(b) Discussion of Known Art

The advantaged of a clip made from spring materials have long been recognized for their simplicity and ease of use. Most known clips consist of a pair of legs or arms that are biased against one another by a spring. Many metal clips take advantage of the modulus of elasticity of sections of metal ribbon to produce an integral clip, having both legs and the spring biasing the legs towards one another made from a single, continuous, section of metal ribbon. Examples of this kind of device can be found in U.S. Pat. No. 609,486 to Wilson shows the use of metal ribbon to create a metal spring. The Wilson device also illustrates the use of legs of uneven length, the shorter leg having a sharp edge to allow the insertion of the short leg between spirals of coiled material, such as ribbon or paper.

Other examples of metal clips can be found in U.S. Pat. Nos. 1,675,286 to Van Valkenburg and 1,621,008 to Fricker. These devices take advantage of the elasticity of metal to provide a clip from a bent section of sheet-metal or metal ribbon. The advantages of sheet-metal or metal ribbon for the manufacture of clips have been difficult to overcome. An important factor that has made metal such an ideal choice for the making of spring clips is that sheet-metal is highly amenable to various cold-working processes that allow the clip to accept a bias, such that the legs of the clip are biased against one another.

While the mechanical properties of many metals lend themselves for the creation of highly effective clips, there remains a need for clips made from materials such as polymers, plastics that provide important mechanical properties that are not inherent in metals. For example, plastics are typically non-abrasive and non-conductive, and are thus innocuous to delicate surfaces or surfaces that must be insulated from electrical currents or protected from galvanic or stress corrosion. Unfortunately, however, it is difficult to take advantage of polymers, and particularly thermoplastics, in the making of spring loaded or biased devices such as clips due to the fact that the polymer must be molded into the shape of the clip. The molding of the material into the shape of the clip makes it difficult to arrive at a clip with legs that retain internal stresses that bias the legs against one another.

Additionally, there remains a need for a plastic, or polymer, clip that can be used for retaining large sections of material together without scarring or scraping the sections of material.

SUMMARY

It has been discovered that the problems left unanswered by known art can be solved by providing a plastic clip of unitary, one piece construction, the clip including at least the following components:

a first leg that is of a first thickness, and a second leg that is of a second thickness, the first leg being biased against the second leg by an bridging section that is greater than the thickness of the first leg or the second leg.

According to a highly preferred embodiment of the invention, the legs of the clip may be of the same or different thickness. The bridging section, is of greater thickness to provide a stiff support for the legs.

The bias of the legs against one another is introduced into the disclosed clip by the molding process used to create the disclosed clip. This process uses a mold that has the legs spaced apart from one another. The mold accepts the thermoplastic material that will be used to form the disclosed clip, and allows the molten thermoplastic material to fill the cavity of the mold, defining the main components of the disclosed clip. Then, a portion of the bridging section is cooled at a faster rate than the remaining portions of the bridging section. This differential cooling introduces internal stresses into the bridging section to introduce a bias forcing the legs against one another.

In a preferred embodiment of the invention one of the legs includes a leading edge that is sloped or rounded towards the opposite leg. This sloping or rounded edge creates a leading edge that provides a smooth transition from a surface that is held between the two legs. It has been discovered that this smooth transition is particularly useful when using the disclosed clip for holding the flaps of containers, such as cardboard boxes, in an open position to allow loading and unloading of the containers. In this application, the tapered leading edge provides an unobtrusive transition between the internal surface of the box and the clip, prevent snagging and inadvertent removal of the clip when removing materials from the container.

Still further, it is contemplated that the leg opposite to the leg with the tapered leading edge will include a flared or bent end that will allow the user to capture materials between the two legs easily.

Thus, as illustrated by this summary, it should be understood that while the above and other advantages and results of the present invention will become apparent to those skilled in the art from the following detailed description and accompanying drawings, showing the contemplated novel construction, combinations and elements as herein described, and more particularly defined by the appended claims. It should also be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
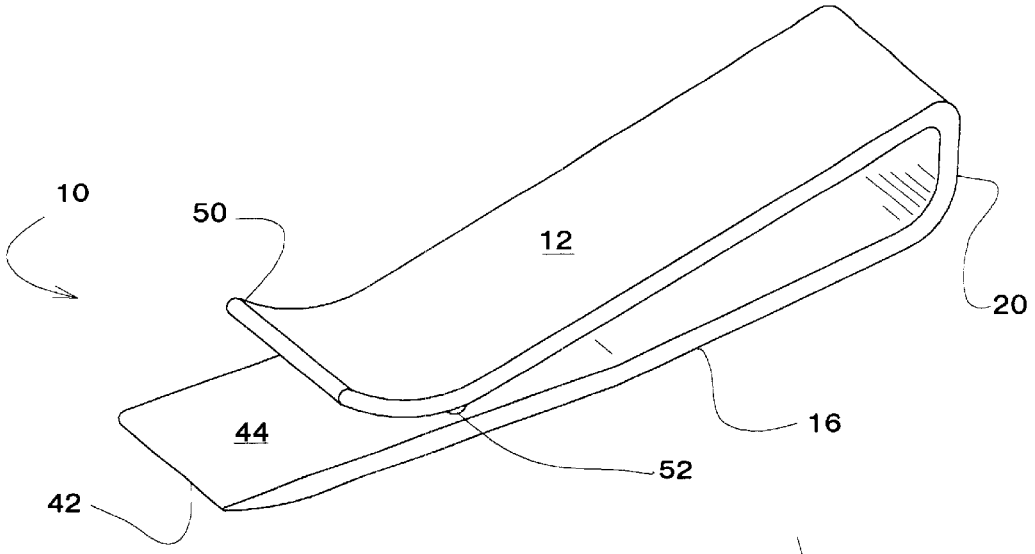
FIG. 1 is a perspective view of an embodiment of the disclosed clip.

Turning now to FIG. 1 where a plastic clip 10 incorporating principles taught herein has been illustrated. As illustrated, a highly preferred embodiment of the plastic clip 10 includes a first leg 12 of a first thickness 14, and a second leg 16 of a second thickness 18. The first leg 12 and the second leg 16 are joined by a bridging section 20, which holds and biases the first leg 12 against the second leg 16. As will be described in greater detail below, a highly preferred embodiment of the plastic clip 10 will be of unitary, one piece, construction, with the first leg 12 and the second leg 16 being permanently urged against one another by internal stresses incorporated into the bridging section. However, it is important to note that the principles taught herein will allow an individual to make a plastic device that has legs that are joined from separate components and biased against one another though a plastic spring element.

Figure 2:
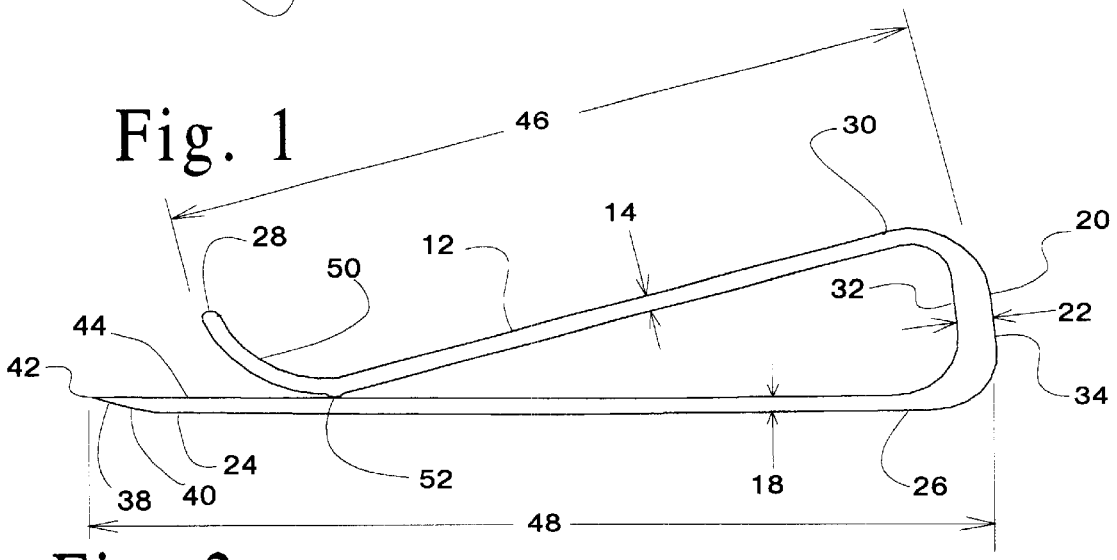
FIG. 2 is a side view of the clip illustrated in FIG. 1.

Turning to FIG. 2 it will be understood that it is also preferred that the bridging section 20 is of a thickness 22 that is greater than the thickness of the first leg 12, referred to herein as the first thickness 14. Similarly, it is contemplated that the thickness 22 of the bridging section 20 will be greater than the second thickness 18 of the second leg 16. The greater thickness of the bridging section 20 will allow the bridging section 20 to achieve greater rigidity than the legs of the clip 10. This enhanced rigidity will allow the development of a strong bias or force that keeps the first leg 12 pressed against, or urged towards, the second leg 16. Furthermore, as will be discussed in further detail below, when the bridging section 20 is made by using a molding process that provides differential cooling of different areas of the bridging section 20, the resulting bridging section 20 will have internal stresses that will bias one leg against the other.

As can be understood from FIG. 2, the second leg 16 includes a first end 24, a second end 26, and a generally planar section 28 that faces the first leg 12. Additionally, the second end 26 of the second leg 16 is connected, and preferably as an integral one piece construction, to the bridging section 20. Similarly, the first leg 12 includes a first end 28 and a second end 30. The second end 30 being integral with the bridging section 20. The bridging section 20 also includes an internal portion 32 and an external portion 34. The internal portion 32 extends between the two legs of the clip 10.

Figure 4:
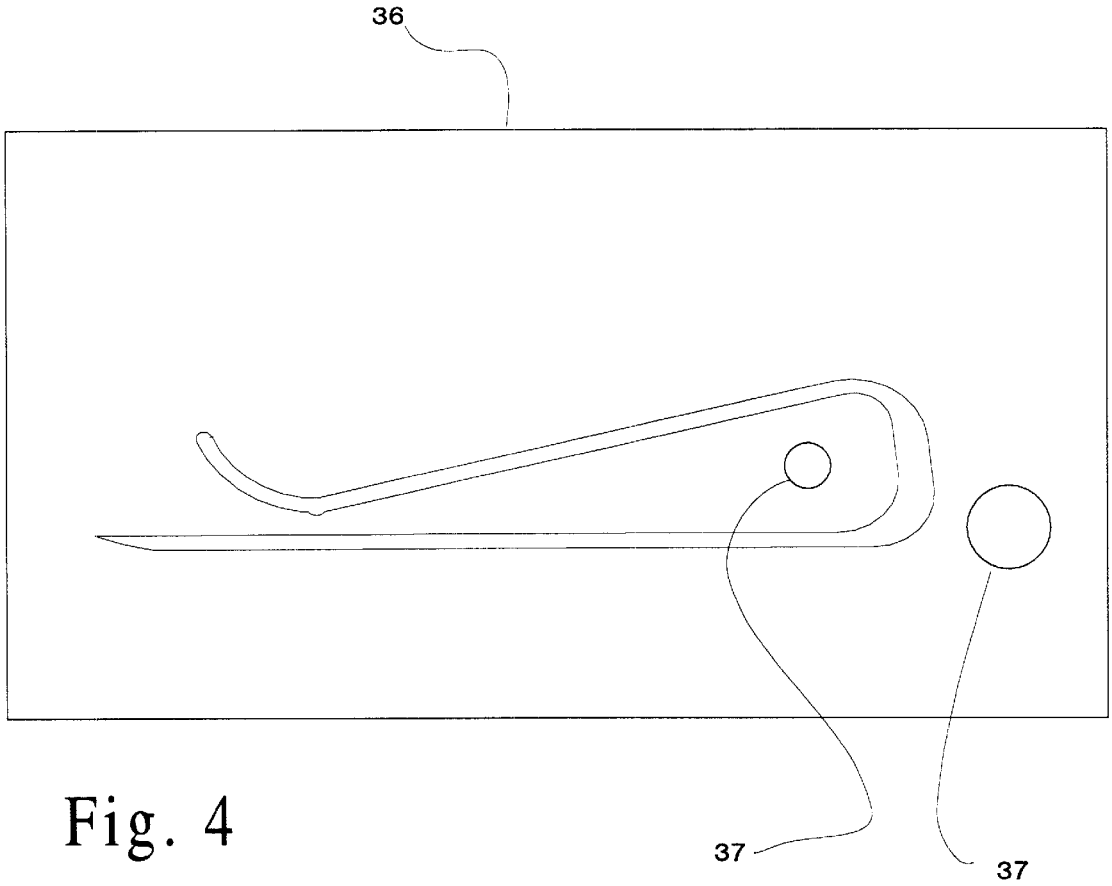
FIG. 4 illustrates a mold cavity, together with cooling passages, used to create the bias of the legs of the disclosed clip.

In order to ensure that the legs of the plastic clip 10 maintain a bias against one another, the disclosed clip 10 is made from a thermoplastic material that shrinks as it cools, or solidifies from a molten state, during the molding or forming process. Referring to FIG. 4, it will be understood that the disclosed clip 10 must be molded with the legs, 12 and 16, spaced from one another. However, to ensure that the legs assume a configuration that is different from the configuration imposed by the mold 36, which as illustrated, forms the clip 10 with each leg as separate element, each being spaced from the other. To create a part that has the legs with a bias against one another, the mold 36 provides a cooling system that allows differential cooling rates as experienced by the internal portion 32 compared to the external portion 34 of the clip 10. The differential cooling is carried out in a manner that achieves solidification of one surface before the opposite surface. The side that solidifies first assumes a fixed dimension or proportion. Then as the opposite side cools, it migrates towards its cooled, solid, dimension or proportion. In this example, the thermoplastic will be of a type that shrinks in dimension as it goes from a molten state to a solid. Thus, by first cooling the external portion 34 to a temperature that solidifies the external portion and sets its dimension or size, while keeping the internal portion 32 in a molten state. Then, the internal portion 32 is cooled until it has solidified, which will also allow the internal portion to shrink as it cools.

Once the clip 10 has cooled enough to be released from the mold 36, it is then ejected from the mold. The differential cooling, meaning the cooling of different surfaces at different times or at different rates, induces internal stresses into the bridging section, the stresses being induced by the fact that the dimension of one section of the part was fixed before the opposing part was allowed to cool and contract. Thus, as shown on FIG. 4, the mold 36 will include a temperature or cooling control mechanism. In the illustrated example this mechanism, or system, is provided by cooling ducts or passages 37 that allow the cooling to be controlled. It is important to note that the passages 37 are provided merely as examples. It is contemplated that instead of passages, the mold 36 may simply include sections of highly conductive metal that provide more efficient heat transfer at desired locations, as well as other systems to carry out the differential cooling taught herein.

Figure 3:
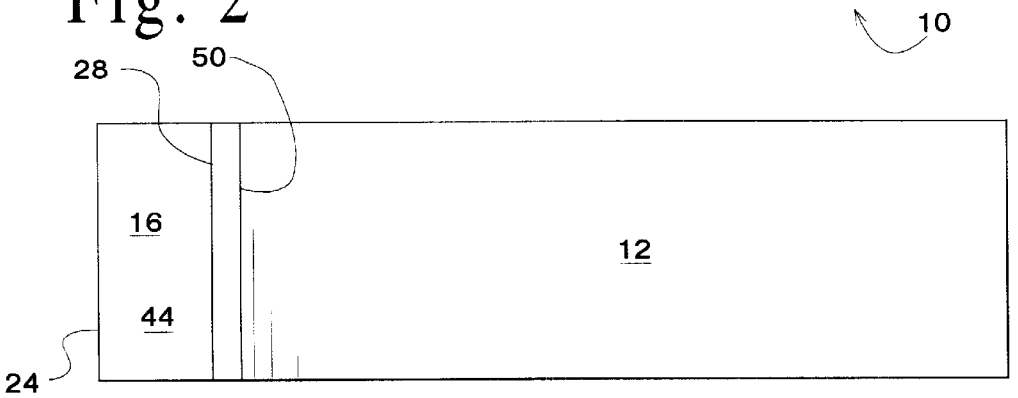
FIG. 3 is a top, plan view of the embodiment illustrated in FIG. 2. The view looking down at the leg with the curled end, opposite to the leg with the tapered edge.

Turning now to FIG. 3 where it has been illustrated that in a preferred embodiment of the invention the first end 24 of the second leg 16 includes a tapered section 38, the tapered section 38 creating an area of gradually increasing thickness 40 starting in an edge 42 on the planar section 44 of the second leg 16 and increasing to the second thickness 18 of the second leg 16.

Also illustrated in FIG. 3 is that in a preferred embodiment of the invention the first leg 12 is of a first length 46 and the second leg 16 is of a second length 48, the second length 48 being greater than the first length 46. Furthermore, the first leg 12 includes an end 50 that curls away from the first end 24 of the second leg 16 to allow the clip to grasp or slide easily over material to be retained between the legs. The tapered section 38 of the second leg 16 has been designed to provide a smooth transition between a surface that is caught between the legs. This transition will allow the clip 10 to be used for tasks such as filling a cardboard box, for example, where the flaps need to be held in open position, away from the opening of the box. In this use the second leg 16 would be positioned against the internal surface of the box, with the flaps trapped between the legs and extending away from the box opening. The tapered section 38 would thus allow easy removal of items being placed into or removed from the box, without snagging the leg of the clip as the item is removed or inserted from the box.

Also, as shown on FIG. 2, a bead 52 has been incorporated into the clip 10 to provide a pressure point between the legs. The bead 52 provides a section of enhanced pressure and grip between the legs of the clip 10.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A plastic clip of unitary, one piece construction, the clip comprising:

a first leg of a first thickness, the first leg having an internal surface;

a second leg of a second thickness, the second leg having an internal surface; and a bridging section joining the first leg and the second leg, the bridging section having an internal portion and an external portion, the internal portion of the bridging section being between and facing the internal surface of the first leg and the internal surface of the second leg, the internal portion of the bridging section having an internal stress produced by cooling of the of the internal surface at a greater rate than the external surface, and so that the bridging section biases the first leg against the second leg.

2. A plastic clip according to claim 1 wherein said bridging section is of a thickness that is greater than the first thickness of the first leg.

3. A plastic clip according to claim 1 wherein said bridging section is of a thickness that is greater than the second thickness of the second leg.

4. A plastic clip according to claim 1 wherein said bridging section is of a thickness that is greater than the first thickness of said first leg and the second thickness of the second leg.

5. A plastic clip according to claim 1 wherein said second leg is of a second length and further comprises a first end and a second end, and a generally planar section facing the first leg, the second end being connected to said bridging section, the first end having a tapered section, the tapered section creating an area of gradually increasing thickness starting in an edge on the planar section of the second leg and increasing to the second thickness of the second section.

6. A plastic clip according to claim 5 wherein said first leg is of a first length, the first length of said first leg being shorter than the second length of the second leg.

7. A plastic clip according to claim 6 wherein said first leg includes an end that curls away from the first end of said second leg.

8. A plastic clip having a first leg of a first thickness, the first leg having an internal surface, a second leg of a second thickness, the second leg having an internal surface and a bridging section joining the first leg and the second leg, the clip being of unitary, one piece construction, the bridging section having an internal portion and an external portion, the internal portion of the bridging section being between and facing the internal surface of the first leg and the internal surface of the second leg, the internal portion of the bridging section having an internal stress that urges the internal surface of the first leg towards the internal surface of the first leg, the internal stress resulting from a thermal shrinkage of the of the internal surface relative to the external surface, and so that the bridging section the first leg and the second leg being permanently urged against one another by the bridging section.

9. A plastic clip according to claim 8 wherein said bridging section is of a thickness that is greater than the first thickness of the first leg.

10. A plastic clip according to claim 8 wherein said bridging section is of a thickness that is greater than the second thickness of the second leg.

11. A plastic clip according to claim 8 wherein said bridging section is of a thickness that is greater than the first thickness of said first leg and the second thickness of the second leg.

12. A plastic clip according to claim 11 wherein said second leg is of a second length and further comprises a first end and a second end, and a generally planar section facing the first leg, the second end being connected to said bridging section, the first end having a tapered section, the tapered section creating an area of gradually increasing thickness starting in an edge on the planar section of the second leg and increasing to the second thickness of the second section.

13. A plastic clip according to claim 12 wherein said first leg is of a first length, the first length of said first leg being shorter than the second length of the second leg.

14. A plastic clip according to claim 13 wherein said first leg includes an end that curls away from the first end of said second leg.

* * * * *